US005623849A

United States Patent [19]

Goff, Jr. et al.

[11] Patent Number: 5,623,849

[45] Date of Patent: Apr. 29, 1997

[54] VERTICALLY ADJUSTABLE TOOL ACTUATORS FOR A SINGLE STAGE FINISHING PRESS

[75] Inventors: Kenneth H. Goff, Jr., Plymouth; William E. Schultz, Canton, both of Mich.

[73] Assignee: Ford Motor Company, Dearborn, Mich.

[21] Appl. No.: 357,964

[22] Filed: Dec. 16, 1994

Related U.S. Application Data

[63] Continuation of Ser. No. 246,589, May 20, 1994, Pat. No. 5,465,600.

[51] Int. Cl.[6] ..... B21D 31/06

[52] U.S. Cl. ..... 72/394; 72/412; 72/403; 72/405.01

[58] Field of Search ..... 72/412, 403, 394, 72/405, 453.01, 472, 446, 447, 313–315, 297, 296, 405.01

[56] References Cited

U.S. PATENT DOCUMENTS

| | | | |
|---|---|---|---|
| 318,088 | 5/1885 | Cooper | 72/447 |
| 545,758 | 9/1895 | Aiken | 72/455 |
| 821,556 | 5/1906 | Vaughan | 72/403 |
| 1,404,911 | 1/1922 | Klocke . | |
| 2,331,491 | 12/1941 | Menkin | 113/42 |
| 2,822,545 | 2/1958 | Eickhoff | 72/313 |
| 3,020,888 | 7/1959 | Braun | 121/40 |
| 3,279,232 | 10/1966 | Dolney | 72/297 |
| 3,393,548 | 7/1968 | Bath | 72/308 |
| 3,456,478 | 7/1967 | Alexander | 72/351 |
| 3,561,248 | 2/1971 | Bessho | 72/383 |
| 3,595,061 | 7/1971 | Bessho | 72/381 |
| 3,802,246 | 4/1974 | Goff | 72/381 |
| 3,802,247 | 4/1974 | Karsnak | 72/405 |
| 4,273,738 | 6/1981 | Spengler | 264/154 |
| 4,753,099 | 6/1988 | Klingel | 72/389 |
| 4,770,024 | 9/1988 | Sauerwald | 72/422 |
| 4,795,124 | 1/1989 | Nagai | 72/422 |
| 4,951,552 | 8/1990 | Fox | 92/27 |
| 5,190,272 | 3/1993 | Zika et al. | 269/309 |
| 5,216,913 | 6/1993 | Post | 72/446 |
| 5,251,969 | 10/1993 | Cezanne et al. | 303/963 |
| 5,253,502 | 10/1993 | Poletti | 72/213 |

FOREIGN PATENT DOCUMENTS

| | | | |
|---|---|---|---|
| 475190 | 6/1975 | U.S.S.R. | 72/315 |

*Primary Examiner*—Daniel C. Crane
*Attorney, Agent, or Firm*—Daniel M. Stock; Roger L. May

[57] ABSTRACT

A press 14 used to impart shape to a workpiece through a tool actuator assembly 62, 63, 64. The press 10 has a crown 16 and a bed 17 between which the workpiece is located. Columns 57, 58, 59, 60 extend between the crown 16 and the bed 17. Each tool actuator assembly 62, 63, 64 is attached to a side of the press and is adjustably mounted between a pair of adjacent press columns.

11 Claims, 3 Drawing Sheets

76
74
78
86
82

VERTICALLY ADJUSTABLE TOOL ACTUATORS FOR A SINGLE STAGE FINISHING PRESS

CROSS-REFERENCE TO RELATED APPLICATION

The present application is a continuation of application Ser. No. 08/246,589, filed May 20, 1994, now U.S. Pat. No. 5,465,600.

TECHNICAL FIELD

This invention relates to a stamping press for shaping a work piece.

BACKGROUND ART

In manufacturing "niche" or low volume vehicles, setup costs and down time must be minimized in order to enable operations to be conducted efficiently. As used herein "low volume" refers to production volumes of less than about 30,000 units per year. Especially in such operations, it is desirable to reduce the number of processing steps. Ideally, the manufacturing engineer would wish to eliminate tooling which is part-specific, so that once mounted, a given tooling could be used to shape more than one part. Such manufacturing objectives rise in significance when one contemplates entry into a new vehicle market with a minimum initial investment.

Generally, as used herein the term "press" connotes an apparatus having a stationary bed or a rolling bolster and a slide or ram that has reciprocating motion at right angles, or parallel to, or inclined to the bed surface, the slide being guided in the frame of the apparatus. A "die" connotes a tool, often containing a cavity, that imparts shape to a solid metal or plastic primarily because of the shape of the tool itself. A die is typically used in such press operations as blanking, drawing, forging, and forming. As used herein, "bolster" refers to a plate to which dies or tools may be fastened, the assembly being secured to the top surface of a press bed.

In manufacturing operations which utilize a press and a die assembly, the die is typically part-specific. When a part having a different shape is to be formed, the die must be replaced or reoriented. Thus, the manufacturing cycle conventionally includes a series of steps within which a die is changed in order to form a specific part. Such steps functionally differ from those involved in the press cycle. In the press cycle, various steps are followed in order to shape a given part from the die components which have been selected.

In related prior art is U.S. Pat. No. 5,216,913 which discloses an improved bending machine for wire- or strip-shaped material. The '913 reference discloses a working plate disposed in a vertical position on a machine frame. U.S. Pat. No. 3,802,246 discloses a multiple motion press for fabricating sheet metal, including a lateral reciprocating ram which is slidably mounted on the press frame. U.S. Pat. No. 3,561,248 discloses a bumper forming apparatus including a pair of longitudinally shaped moveable male die members adapted to move toward and away from each other. Also illustrative as references disclosing bending presses for sheet materials are U.S. Pat. Nos. 4,753,099 and 5,253,502.

A die assembly used within a single stage forming operation is disclosed in our U.S. Pat. No. 5,465,600, which is incorporated herein by reference.

SUMMARY OF THE INVENTION

To meet the needs of advanced manufacturing technology and small volume production lots, what is needed is a single stage forming operation which has the ability to form from all sides, as well as from the top and bottom, so that the benefits of reduced tooling investment, shorter tooling lead time, and improved product marketing flexibility may be realized. Preferably, a new press design should offer the opportunity to access the work piece from some or all of three sides of the press.

Accordingly, the invention includes a plurality of tool actuator assemblies attached to the sides of the press. They are disposed within the press used to impart shape to a workpiece. Conventionally, the press has upper and lower die shoes between which the workpiece is located, and press columns extending between the die shoes. According to the present invention, the side tool actuator assemblies are adjustably mounted between a pair of adjacent press columns. In the preferred embodiment, each side tool actuator assembly includes two tool actuator banks.

In the preferred embodiment, one side tool actuator assembly is located on each side of the press, and one side tool actuator assembly is located at the back of the press. Thus, the side tool actuator assemblies are located on three of the four sides of the press, leaving its front open for ready access during changeover operations and for part loading and unloading.

Further features and advantages of the present invention will be apparent from the following detailed description taken in conjunction with the accompanying drawings.

BEST MODE(S) FOR CARRYING OUT THE INVENTION

Figure 1:
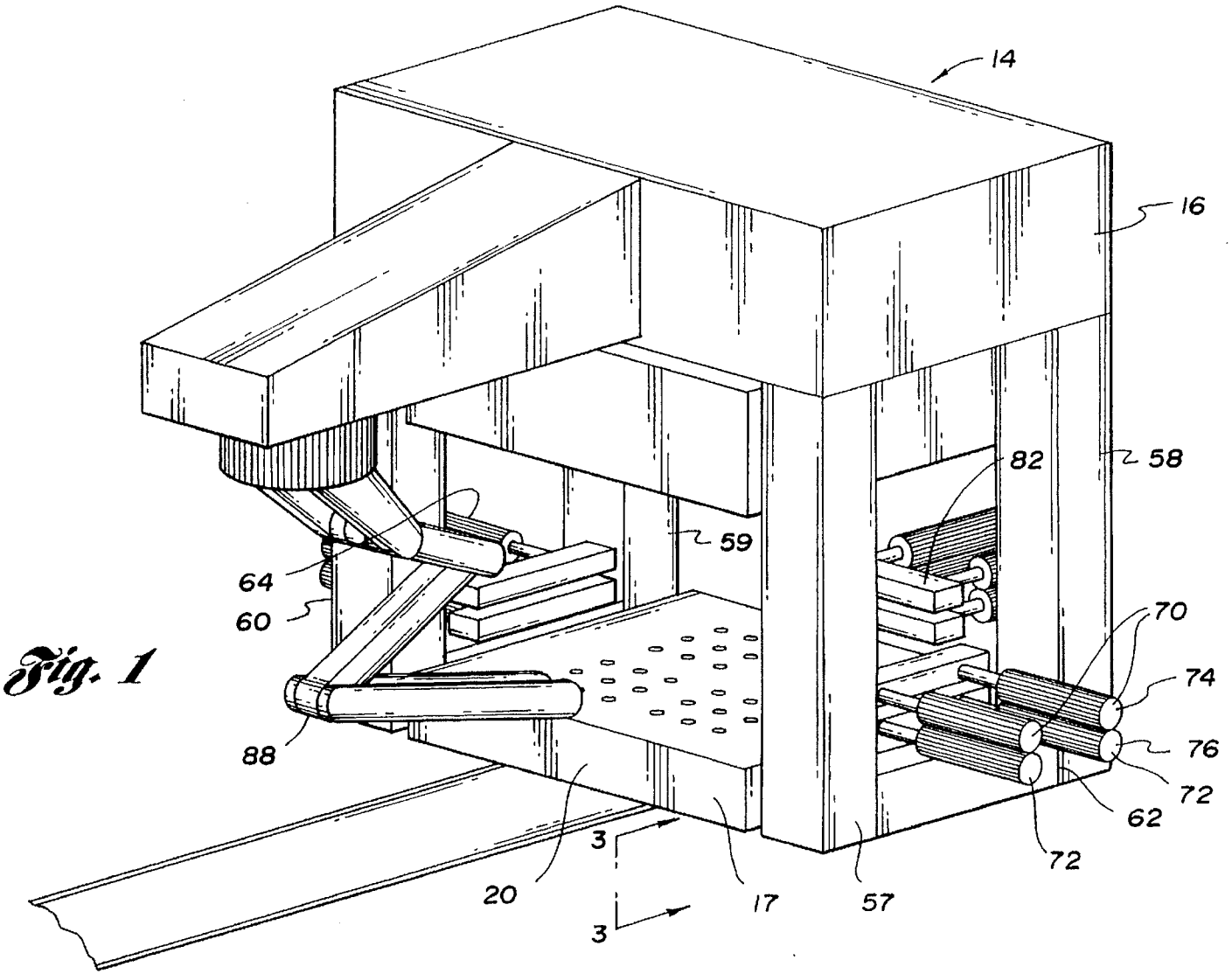
FIG. 1 depicts an operating environment within which adjustable side and rear tool actuator assemblies for a press are situated.

Turning to FIG. 1 of the drawings, there is depicted a press 14 which is used to impart shape to a workpiece through tool assemblies 62, 63, 64. The press 14 has a crown 16 and a bed 17 between which the workpiece is located. Columns 57, 58, 59, 60 extend between the crown 16 and the bed 17.

Each tool actuator assembly 62, 63, 64 is attached to a side of the press and is adjustably mounted between a pair of adjacent press columns. For example, tool actuator assembly 62 is supported between columns 57, 58. The assembly 62 can be column mounted or free standing. Tool actuator assembly 63 is supported between columns 58, 59, and tool actuator assembly 64 is supported between columns 59,60.

Each tool actuator assembly 62, 63, 64 comprises a pair of tool actuator banks. For example, assembly 62 includes banks 70, 72. Each bank has upper cylinders connected together and lower cylinders connected together to a die engaging member 82 (FIGS. 1, 2) and mounted to frame 86 (FIG. 3). A similar equipment complement is located at the opposing side assembly 64 and at the rear assembly 63.

The press which houses the present invention is a programmable hydraulic press. The tool actuator assemblies permit flexibility in die configuration and the timing of various forming operations that are not possible in current production stamping presses.

Figure 2:
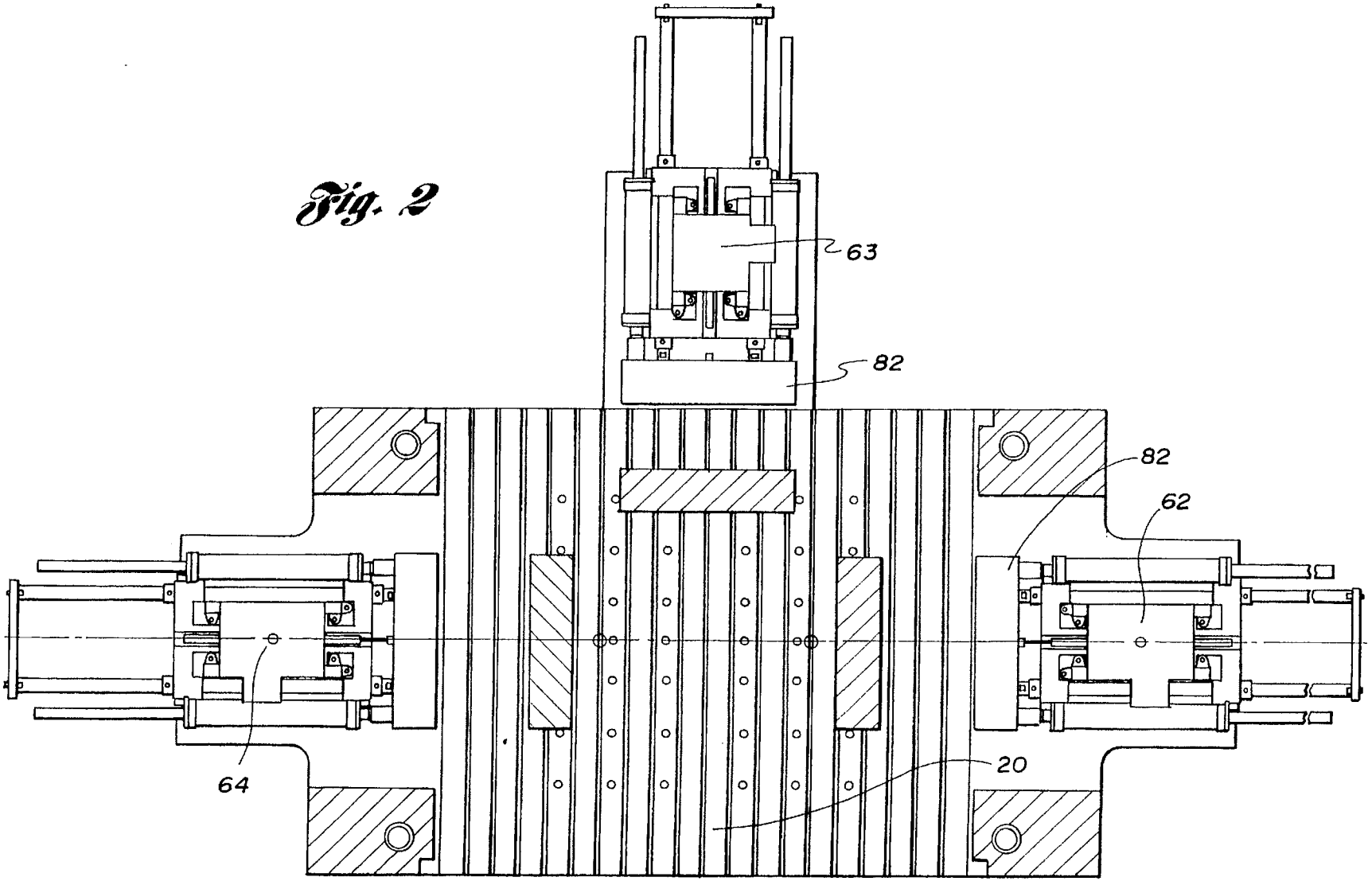
FIG. 2 is a top plan view of a press illustrating the vertically adjustable side and rear tool actuator assemblies.
Figure 3:
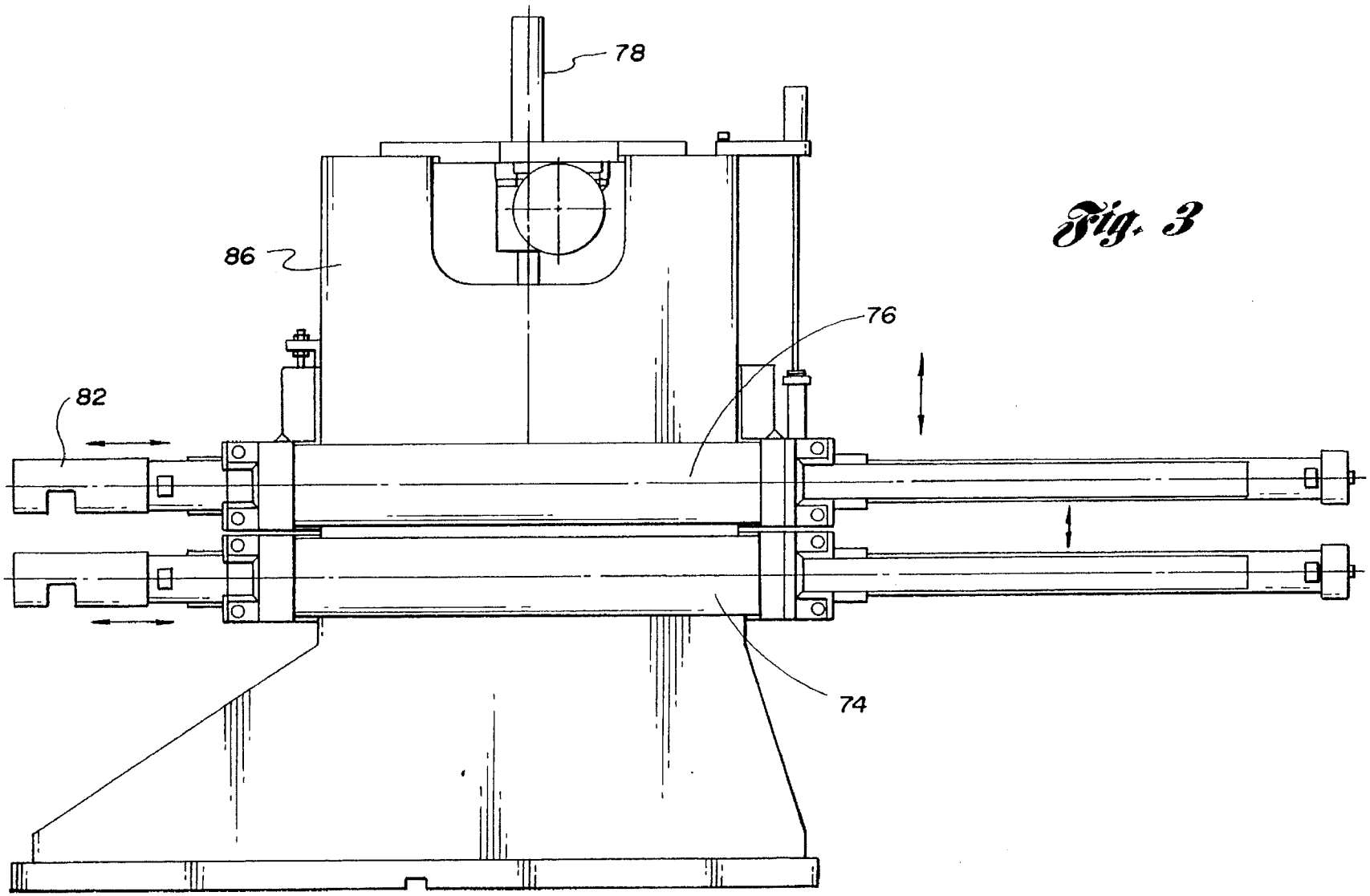
FIG. 3 is a side elevational view of the tool actuator assemblies 62 when viewed from the front of the press along the line 3—3 of FIG. 1.

FIGS. 2–3 depict in greater detail the adjustable side and rear tool actuator assemblies or forming slides in the disclosed multi-directional sheet metal forming press. Vertical adjustment of the press-mounted work slides allows each work cylinder 74, 76 within the press to be readily aligned with slides which accommodate the working tool or die assemblies. Additionally, vertical adjustment of the side and rear press-mounted actuators permits much greater flexibility in the design of flanging, forming and piercing dies.

In the operating environment of a multi-directional sheet forming press used in low volume production, vertical adjustment of the horizontal forming slides provides flexibility in accommodating different forming tools (dies). The ability to program the vertical position of each of the upper and lower horizontal slides to perform work on different areas of the die is a distinct manufacturing advantage. This is because vertical adjustment provides the opportunity to form a larger variety of parts, and parts that require more complex dies in a conventional single-directional press.

In the present invention, this adjustment is optionally provided through the use of a position ball screw 78 coupled with a position encoding device 80 (FIG. 3), or by equivalent means.

The press disclosed herein includes a rolling bolster 20 (FIG. 1) which enables dies to be interchanged rapidly. A programmable robot 88 is mounted on the press for loading and unloading a workpiece.

During die change steps, the following operations are performed:

1. Present the die to the press using a rolling bolster;
2. Communicate to the press what die will be used; and
3. Move the actuators to a die-specific position vertically, or horizontally, or vertically and horizontally.

During the press cycle in which the workpiece is shaped, various portions of the die are conventionally urged by actuators to form the workpiece in a pre-programmed sequence. Upon completion, the actuators are retracted to the die-specific position (3) above. After the low volume production run is complete, the actuators may be further retracted to an initial position in readiness for any die changing operations which need to be performed in order to shape a different workpiece.

Each tool actuator assembly 62, 63, 64 is programmable in two respects: (1) each actuator 74, 76 can be preset so that it moves to a given position in space within the press so as to accommodate the dimensions of a particular die, thereby reducing cycle time; and (2) can be constrained to move within given dimensions so as to avoid, for example, bottoming-out.

The adjustment means by which each actuator assembly 62, 63, 64 may be vertically adjustable is by use of a hydraulically actuated ball screw with position sensing provided by a Hall-effect measurement device. Other positioning devices such as encoders could be used instead.

The cylinders are adjustable in the sense that the start point and speed at which pressing forces can be applied are user-programmable. Each cylinder has movement which is independent of other cylinders.

Among the design criteria of the disclosed press is that pressure must not diminish if multiple cylinders are being used.

The invention also includes displays which indicates the status of each cylinder, e.g. "cylinder fully retracted" or "cylinder in motion".

Among the disclosed programmable features are means for controlling individually each cylinder's start and stop sequence.

For the types of operations described herein, conventional prior art approaches require a cycle time of no less than about 90 seconds. Using the vertically adjustable actuators of the present invention, however, cycle times are reduced by about 50% to 45 seconds. Additionally, the disclosed mechanism permits a wider range of more complex parts to be formed.

Turning now to FIG. 3, additional details will be provided of each tool actuator assembly 62 of the present invention. The following description below focusing on assembly 62 should be considered to be representative of actuator assemblies 63, 64.

Each assembly 62 includes a frame 86 which supports a position encoding device 80. For brevity, other member components are considered conventional and will not be described here at length. They include a rod end coupler, an hydraulic cylinder, a guide rod, upper and lower crossheads, and an hydraulic motor for urging the die engaging members 82 toward tool engagement. Adjustment is enabled through the use of a precision ball screw coupled with a position encoding device.

Preferably, the vertically adjustable tool actuators disposed at the rear of the press have longer cylinder members.

In summary, the vertically adjustable tool actuator assemblies provide flexibility to the manufacturing engineer in that a wider range of die components can be used within the press to prepare a variety of workpieces. Vertical adjustment of the press mounted slides allow cylinders to be more easily aligned with the dies. They permit much greater flexibility in the design of flanging, forming, and piercing dies for use in the press. Thus, a larger variety of parts and parts that require more complex tools (dies) in the multi-directional press can be accommodated.

Preferably, the disclosed press has up to a 500 ton capacity. The rolling bolster or an equivalent mechanism enables dies to be changed quickly and mounted on the press through use of the programmable robot 88 which also allows workpieces such as panels to be loaded and unloaded. Each cylinder, in the preferred embodiment, has a 36 inch stroke and may exert pressure of up to 40 metric tons each. The amount of vertical adjustment includes about 12 inches of travel.

What is claimed is:

1. In a press used to impart shape to a workpiece, the press having a crown and a bed between which the workpiece is located, opposed tools movable relative to one another within the crown and the bed so as to impart shape to the workpiece, and columns extending between the crown and the bed, an improvement comprising:

a plurality of tool actuator assemblies in communication with the tools, each actuator assembly having means to operate on said workpiece in cooperation with said tools, each tool actuator assembly being attached to and being adjustably mounted horizontally and vertically between a pair of adjacent columns independently of the reciprocatory motion of the press so that adjustment or actuation may be made before, during, or after press operation.

2. In a press used to impart shape to a workpiece, the press having a crown and a bed between which the workpiece is located, opposed tools movable relative to one another within the crown and the bed so as to impart shape to the workpiece, and columns extending between the crown and the bed, an improvement comprising:

a plurality of tool actuator assemblies in communication with the tools, each actuator assembly having means to operate on said workpiece in cooperation with said tools, each tool actuator assembly being attached to and being adjustably mounted horizontally and vertically between a pair of adjacent columns, each tool actuator assembly comprising:

a pair of tool actuator banks, each bank having two cylinders connected together to a die engaging member and a frame that permits vertical adjustment and flexibility in die configuration, timing and forming operations.

3. In a press used to impart shape workpiece, the press having a crown and a bed between which the workpiece is located, opposed tools movable relative to one another within the crown and the bed so as to impart shape to the workpiece, and columns extending between the crown and the bed, an improvement comprising:

a plurality of tool actuator assemblies in communication with the tools, each actuator assembly having means to operate on said workpiece in cooperation with said tools, each tool actuator assembly being attached to and being adjustably mounted horizontally and vertically between a pair of adjacent columns so that adjustment may be made before or during press operation independently of the reciprocatory motion of the press, each tool actuator assembly comprising a pair of tool actuator banks, each bank having two cylinders connected together to a die engaging member and a frame that permits vertical adjustment and flexibility in die configuration, timing and forming operations.

4. The press of claim 1, wherein the plurality of tool actuator assemblies comprises:

a pair of side tool actuator assemblies flanking a rear tool actuator assembly.

5. The press of claim 1, wherein the plurality of tool actuator assemblies comprises:

three tool actuator assemblies.

6. The press of claim 1, further comprising:

means for adjusting each tool actuator assembly in relation to its associated columns so that positioning and shaping forces may be selectively applied to one or more tools in the tool assembly that are adapted to form the workpiece.

7. The press of claim 6, wherein the means for adjusting comprises:

means for adjusting the position of a tool actuator assembly along an axis parallel to the columns between which the tool actuator assembly is adjustably mounted.

8. The press of claim 6, wherein the means for adjusting comprises:

means for adjusting the position of a tool actuator bank along an axis that is skewed in relation to its associated columns.

9. The press of claim 6, wherein the means for adjusting comprises:

means for positioning each tool actuator assembly so that it moves to a predetermined position within the press to accommodate the dimensions of a particular die in the tool assembly.

10. The press of claim 6, wherein the means for adjusting comprises:

means for constraining movement of each tool actuator assembly so that it moves between predetermined locations; and means for positioning each tool actuator assembly so that it moves to a predetermined position within the press to accommodate the dimensions of a particular die in the tool assembly.

11. In a press used to impart shape to a workpiece, the press having a crown and a bed between which the workpiece is located, opposed tools movable relative to one another within the crown and the bed so as to impart shape to the workpiece, and columns extending between the crown and the bed, an improvement comprising:

a plurality of tool actuator assemblies in communication with the tools, each actuator assembly having means to operate on said workpiece in cooperation with said tools, each tool actuator assembly being attached to and being adjustably mounted horizontally and vertically between a pair of adjacent columns independently of the reciprocatory motion of the press so that adjustment may be made before or during press operation, each tool actuator assembly having a pair of tool actuator banks, each bank having two cylinders connected together to a die engaging member and a frame that permits vertical adjustment and flexibility in die configuration, timing and forming operations; and a programmable robot for loading and unloading the workpiece.

* * * * *